US009976249B2

(12) United States Patent
Lv et al.

(10) Patent No.: US 9,976,249 B2
(45) Date of Patent: May 22, 2018

(54) DRYER OR WASHER DRYER

(71) Applicants: HAIER GROUP CORPORATION, Shandong (CN); QINGDAO HAIER DRUM WASHING MACHINE CO., LTD., Shandong (CN)

(72) Inventors: Peishi Lv, Shandong (CN); Yonghong Xu, Shandong (CN); Lijun Zhang, Shandong (CN); Huacheng Zhang, Shandong (CN); Yuliang Jiang, Shandong (CN)

(73) Assignees: Haier Group Corporation, Shandong (CN); Qingdao Haier Drum Washing Machine Co., Ltd., Shandong (CN)

( * ) Notice: Subject to any disclaimer, the term of this patent is extended or adjusted under 35 U.S.C. 154(b) by 0 days. days.

(21) Appl. No.: 15/125,644

(22) PCT Filed: Jun. 10, 2014

(86) PCT No.: PCT/CN2014/079582
§ 371 (c)(1),
(2) Date: Sep. 13, 2016

(87) PCT Pub. No.: WO2015/135263
PCT Pub. Date: Sep. 17, 2015

(65) Prior Publication Data

US 2016/0376744 A1 Dec. 29, 2016

(30) Foreign Application Priority Data

Mar. 14, 2014 (CN) ..... 2014 1 0097912

(51) Int. Cl.
*D06F 58/24* (2006.01)
*F28F 9/00* (2006.01)
(Continued)

(52) U.S. Cl.
CPC ..... *D06F 58/24* (2013.01); *D06F 25/00* (2013.01); *D06F 58/02* (2013.01); *D06F 58/22* (2013.01);
(Continued)

(58) Field of Classification Search
CPC ..... D06F 58/24; D06F 25/00; D06F 58/02; D06F 58/22; F28D 9/0037; F28D 21/0014; F28F 9/001
(Continued)

(56) References Cited

U.S. PATENT DOCUMENTS 8,182,612 B2 * 5/2012 Grunert ..... D06F 58/20 134/22.18
8,256,137 B2 * 9/2012 Noviello ..... D06F 58/20 34/413
(Continued)

FOREIGN PATENT DOCUMENTS

CN 1955368 A1 5/2007
CN 102517860 A 6/2012
(Continued)

OTHER PUBLICATIONS

International Search Report dated Dec. 17, 2014 from International Patent Application No. PCT/CN2014/079582 filed Jun. 10, 2014.
(Continued)

*Primary Examiner* — Stephen M Gravini
(74) *Attorney, Agent, or Firm* — Sunstone IP

(57) ABSTRACT

Disclosed is a dryer or a washer dryer, including at least a clothes drying system, where the clothes drying system includes a heating structure and a condensing structure; the condensing structure is arranged on a lower part of the dryer or the washer dryer; the condensing structure includes an air inlet and an air outlet for hot air, and further includes a gas inlet and a gas outlet for cold air, and a heat exchanger is
(Continued)

arranged inside the condensing structure; the heat exchanger is composed of fins which are superposed in a longitudinal-transverse alternating manner, and a frame with an enclosure structure is arranged outside the heat exchanger.

16 Claims, 10 Drawing Sheets

(51) Int. Cl.

| | |
|---|---|
| ***F28D 9/00*** | (2006.01) |
| ***F28D 21/00*** | (2006.01) |
| ***D06F 25/00*** | (2006.01) |
| ***D06F 58/02*** | (2006.01) |
| ***D06F 58/22*** | (2006.01) |

(52) U.S. Cl.
CPC ..... *F28D 9/0037* (2013.01); *F28D 21/0014* (2013.01); *F28F 9/001* (2013.01)

(58) Field of Classification Search
USPC ..... 34/73, 595–610; 68/19, 20
See application file for complete search history.

(56) References Cited

U.S. PATENT DOCUMENTS

| | | | | |
|---|---|---|---|---|
| 8,312,640 | B2 * | 11/2012 | Taniguchi | D06F 58/02 34/134 |
| 8,356,423 | B2 * | 1/2013 | Corberan Salvador | D06F 58/22 165/158 |
| 8,578,626 | B2 * | 11/2013 | Steffens | D06F 58/206 134/198 |
| 8,857,071 | B2 * | 10/2014 | Lee | D06F 58/206 34/85 |
| D739,095 | S * | 9/2015 | Shu | D32/6 |
| 9,249,538 | B2 * | 2/2016 | Bison | D06F 58/206 |
| 9,255,732 | B2 * | 2/2016 | Shu | D06F 58/206 |
| 9,534,329 | B2 * | 1/2017 | Contarini | D06F 39/02 |
| 2012/0030959 | A1 * | 2/2012 | Yang | D06F 58/02 34/86 |
| 2016/0115643 | A1 * | 4/2016 | Bison | D06F 58/24 34/468 |
| 2016/0376744 | A1 * | 12/2016 | Lv | F28F 9/001 34/73 |
| 2017/0010047 | A1 * | 1/2017 | Lv | D06F 58/24 |
| 2017/0198428 | A1 * | 7/2017 | Lv | D06F 58/206 |

FOREIGN PATENT DOCUMENTS

| | | | | |
|---|---|---|---|---|
| CN | 102517861 | A | 6/2012 | |
| EP | 0429953 | A2 | 6/1991 | |
| EP | 1621661 | A2 | 2/2006 | |
| EP | 1734170 | A1 | 12/2006 | |
| EP | 1736591 | A1 | 12/2006 | |
| EP | 1783450 | A1 | 5/2007 | |
| EP | 1621661 | A3 | 12/2008 | |
| EP | 2573252 | A1 * | 3/2013 | D06F 58/206 |
| EP | 2808437 | A1 * | 12/2014 | D06F 58/02 |
| EP | 3118364 | A1 * | 1/2017 | F28F 9/001 |
| EP | 2808437 | B1 * | 2/2017 | D06F 58/02 |
| WO | 2011003795 | A1 | 1/2011 | |
| WO | WO 2013045477 | A1 * | 4/2013 | D06F 58/206 |
| WO | WO 2015135263 | A1 * | 9/2015 | F28F 9/001 |

OTHER PUBLICATIONS

European Search Report dated Oct. 10, 2017 from European Patent Application No. 14885515.8 filed Jun. 10, 2014.

* cited by examiner

DRYER OR WASHER DRYER

CROSS REFERENCE TO RELATED APPLICATION(S)

This application is a U.S. National Stage Entry of International Patent Application No. PCT/CN2014/079582, filed Jun. 10, 2014, which claims priority to Chinese Patent Application No. 201410097912.5, filed Mar. 14, 2014, the disclosures of which are hereby incorporated entirely herein by reference.

TECHNICAL FIELD

The present disclosure relates to the field of clothes drying, and particularly relates to a dryer or a washer dryer.

TECHNICAL BACKGROUND

With the continuous upgrading and optimization of energy efficiency standards in the household appliance industry, more and more users begin to focus on energy efficiency parameters of products, and energy conservation and environment protection have become a development direction of the industry.

Therefore, a drying capacity of a three-in-one clothes washing-drying machine with functions of washing, dehydrating and drying is also upgraded with the updating of the industry. During a drying process of a drum clothes washing-drying machine, energy is used for both evaporating water of clothes into steam and continuing to condense the evaporated steam into water vapor.

There are three types of condensation manners in the industry currently. The first manner is that cold water of running water is used for condensing steam, and the manner has the advantages of low manufacturing cost and simple application, and has the disadvantage of high water consumption due to the need of continuous water feeding and cooling in running of the machine. The second manner is that a compressor is used and a refrigerant is used for condensing the steam by virtue of a principle of the compressor, and the manner has the advantages of low energy efficiency, and low water consumption and power consumption, and has the disadvantages of high cost, high price and no benefit to popularization. The third manner is that an air heat exchanger is used and external air is used for condensing the steam, and the manner saves water and power, and has low equipment cost in spite of condensation efficiency which is lower than that of a compressor.

In the existing art, a heat exchanger is made of an aluminum alloy material, and is produced in two ways; one way is an aluminum alloy flat plate design which facilitates the steam to pass, and the other way is a zigzag aluminum plate design which facilitates heat dissipation. At most two heat dissipation paths are produced generally due to a space limit of the clothes dryer, the production cost of the aluminum alloy material is high, the heat dissipation effect is limited by a production process for aluminum alloy sheets, and the contact area of the steam and a condenser is small and not beneficial to steam condensation.

In order to increase a heat dissipation area, a plastic sheet-type heat exchanger is formed by stacking and lapping a plurality of fins which are arranged in a longitudinal-transverse alternating manner, and is made from a plastic material and simple to form; the thickness is controllable and can be controlled to be quite thin; the number of the fins can be increased in an effective space, so that the heat dissipation area can be increased, and then the heat exchange efficiency is increased; the fins are directly placed and stacked in a longitudinal-transverse alternating manner without the need of other connection components, and positioning is simple and accurate; however, thinner sheets bring reduced strength and reduced reliability, and are deformed after being used for a long time, thereby influencing product performance; a frame is additionally arranged outside the heat exchanger, the plastic sheet-type heat exchanger is required to achieve a small production thickness and a large number, and the plastic sheet-type heat exchanger and the frame are mutually assembled; lots of lint are generated during a clothes drying process, and the machine is not easy to clean in case of being blocked by the lint; the section area of each air duct of the clothes drying machine is different from the section area of an air inlet of a heat exchange structure of an air condenser, easily causing air inlet non-uniformity of a condensing structure; and an unsatisfactory condensing effect is caused due to the air inlet non-uniformity of the condensing structure.

In view of this, the present disclosure is set forth.

SUMMARY

The objective of the present disclosure is to overcome the shortages of the existing art, and provide a clothes dryer or a washer dryer provided with a condensing structure having high heat exchange efficiency.

In order to realize the objective, the following technical solution is adopted in the present disclosure: a clothes dryer or a washer dryer, including at least a clothes drying system, where the clothes drying system includes a heating structure and a condensing structure; the condensing structure is arranged on a lower part of the dryer or the washer dryer; the condensing structure includes an air inlet and an air outlet for hot air, and further includes a gas inlet and a gas outlet for cold air, and a heat exchanger is arranged inside the condensing structure; the heat exchanger is composed of fins which are superposed in a longitudinal-transverse alternating manner, and a frame with an enclosure structure is arranged outside the heat exchanger.

A length direction of the condensing structure is arranged vertically to a front panel or a side plate of the washer dryer; an air inlet of the condensing structure is located in an upper part, an air outlet of the condensing structure is located in a lower part, and the air inlet and the air outlet are communicated with a drum through an air duct respectively; and one of the gas inlet and the gas outlet is provided with fans, and the other one is communicated with the atmosphere.

The heat exchanger includes a plurality of fins which are superposed up; two opposite side edges of each fin are bent upwards to form a ventilating air path in coordination with an upper fin, and adjacent fins are arranged in a mode of vertical-horizontal alternating so as to form transversal air paths and longitudinal air paths independent from each other; the longitudinal air path is vertically arranged to correspond to the air inlet and the air outlet; the transversal air path is horizontally arranged to correspond to the gas inlet and the gas outlet; downwards convex pins may be arranged on lower surfaces of two upwards bent side edges of the fin, and downwards concave slots are arranged in upper surfaces of other two sides edges, and pins of the fins are inserted into slots on lower fins so as to connect an upper and a lower adjacent fins.

A plurality of downward profiled grooves are provided in parallel are provided in a direction vertical to the air path formed by the fin and an upper fin, and an air path formed with a lower fin is divided into a plurality of parallel air paths by the profiled grooves; downward profiled grooves may be provided on the fin in an air inlet and an air outlet in the front and rear of air paths formed between the fin and an upper fin, and the profiled grooves form the slots; and, a profiled depth on both ends of the profiled groove may be greater than a profiled depth in middle of the profiled groove, so that a downward bulge is formed, so as to form the pin.

Four side edges of the fin are bent outwards to form turn-ups; turn-ups of adjoining upper and lower fins are overlapped, turn-ups at the slots are overlapped and fitted closely on turn-ups, which are bent upwards first before bent outwards, on a lower fin; and, the fins may be plastic fins.

Frame plates are arranged on an upper side, a lower side, a left side, a right side, a front side and a rear side of the heat exchanger, and the frame is of an enclosure structure formed by connecting the frame plates arranged on the sides of the heat exchanger; wherein through holes cooperated with air paths of an internal heat exchanger are arranged in two groups of frame plates opposite to the transversal air path and longitudinal air path, and the other group of opposite frame plate are flat plates; and, the through holes may be rectangular through holes arranged transversally and longitudinally.

A connection part is arranged at the junction of each frame plate on the frame, and adjacent frame plates are connected through connection parts; each connection part may be of a buckle structure; a plurality of parallel grooves may be arranged on internal surfaces of two groups of frame plates with the through holes, and the grooves correspond to the closely fitted turn-ups, and the closely fitted turn-ups are inserted into the grooves of internal surfaces of corresponding frame plates; and, a plurality of sheet-shaped bulges vertical to frame plates may be arranged on adjacent edges of the two groups of frame plates with the through holes; a shape of the sheet-shaped bulges is identical with that of a space between corresponding adjacent turn-ups at the pin, and the sheet-shaped bulges are respectively inserted into the space between corresponding adjacent turn-ups at the pins.

An upper cover plate is arranged at the hot air inlets of the heat exchanger, the upper cover plate has a inclined top surface, the upper cover plate forms a chamber with the heat exchanger, and the air inlet of the condensing structure is formed on the chamber at one end where the upper cover plate is inclined highly and away from the heat exchanger; a lower cover plate is arranged at the hot air outlets of the heat exchanger, one side of the lower cover plate is the air outlet of the condensing structure; and the upper cover plate and the lower cover plate are connected with flat frame plates.

A filtering structure is arranged between the air inlet of the condensing structure and the hot air inlets of the heat exchanger; the filtering structure is arranged between the air inlet of the condensing structure and the hot air inlet of the heat exchanger in a pushable-pullable manner; the filtering structure may be arranged in the chamber, the filtering structure is slidably connected with sidewalls of the chamber, one end of the filtering structure protrudes out of the chamber, and when one end of the filtering structure is located in the innermost part of the chamber, the other end of the filtering structure is located outside the chamber and hermetically connected with an opening of the chamber through which the filter penetrates; and, sliding chutes/sliding blocks may be arranged on two side edges of the filtering structure, and sliding blocks/sliding chutes are arranged on corresponding sidewalls of the chamber, and the sliding chutes/sliding blocks are matched with the sliding blocks/sliding chutes so as to form sliding connection.

A flushing structure is arranged between the air inlet of the condensing structure and the hot air inlets of the heat exchanger; the flushing structure may include a spray layer and a sealing cover which form a cavity; a plurality of spray holes are arranged in the spray layer; water inlets are arranged in the sealing cover; the spray layer serves as the upper cover plate arranged at the hot air inlets of the heat exchanger; the sealing cover is arranged on an upper part of the upper cover plate and hermetically connected with the upper cover plate, and a plurality of spray holes are arranged in the upper cover plate.

An air intake uniform structure is arranged between the air inlet of the condensing structure and the hot air inlets of the heat exchanger; a plurality of vertical ribbed slabs may be arranged in the air inlet and on an inner surface of top of the upper cover plate so as to divide the air inlet into a plurality of uniform air paths, so that the air intake uniform structure is formed; an air outtake uniform structure is arranged between the air outlet of the condensing structure and the hot air outlets of the heat exchanger; and, a lower cover plate may be arranged at a condensed hot air outlet of the heat exchanger, a plurality of air outlets are arranged on one side of the lower cover plate, and the plurality of air outlets in a shape of Chinese character "众" are communicated to a general air outlet, so that the air outtake uniform structure is formed.

After the technical solution of the present disclosure is adopted, the following beneficial effects are brought:

1. The heat exchanger in the present disclosure is composed of the plastic fins, and is simple to form; the thickness is controllable and can be controlled to be quite thin; the number of the fins can be increased in an effective space, so that the heat dissipation area can be increased and then the heat exchange efficiency is increased; and the profiled grooves are capable of playing a role of location, forming the air paths to guide air flows, enhancing the strength of the fins to prevent deformation, and increasing the contact heat dissipation area to increase the heat exchange efficiency.

2. The frame is arranged outside the heat exchanger in the present disclosure, and is capable of fixing the heat exchanger, enhancing the strength of the heat exchanger, improving the running reliability of the heat exchanger, prolonging the service life, reducing the failure maintenance rate of the machine, and reducing the maintenance cost of the machine; and the frame and each fin are positioned and connected, mutually assembled, mutually supported and firmly connected, and the frame is simple in structure and convenient to install.

3. The filtering structure is arranged in the present disclosure, and used for filtering lint generated during a clothes drying process, thereby avoiding blockage for the air paths of the heat exchanger, and the filtering structure is slidably connected in a withdrawing manner, and can be withdrawn to be cleaned, and the operation is convenient.

4. The flushing structure is arranged in the present disclosure, and is capable of automatically washing the lint in the filtering structure or the air paths of the heat exchanger, thereby avoiding the increase of a wind drag coefficient of the system due to the lint, and prolonging the service life of the heat exchanger; and water flows are adopted for washing instead of manual cleaning, thereby improving the automation level of the machine.

5. The air uniform structures are arranged in the present disclosure, and the air flows at the air inlet and the air outlet are uniformly transited, and are uniformly distributed into all the air paths of the heat exchanger to be condensed; on one hand, the non-uniformity of hot air is avoided, and then the heat exchange efficiency is increased; and on the other hand, the influence of non-uniformity of a pressure caused by the non-uniformity of the air flows on the system is avoided.

The specific embodiments of the present disclosure will be further described below in detail with reference to the accompanying drawings.

REFERENCE NUMBERS

Figure 1:
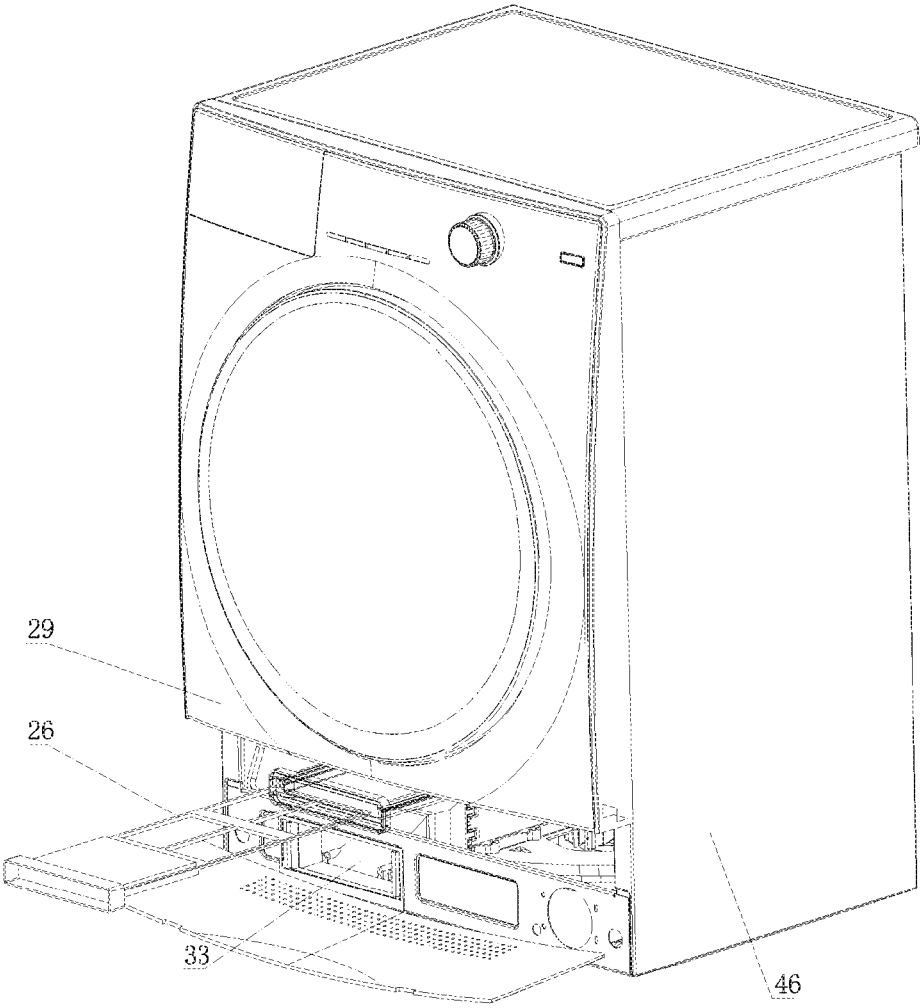
FIG. 1 is an external structural diagram of a clothes dryer machine or a washer dryer of the present disclosure.
Figure 2:
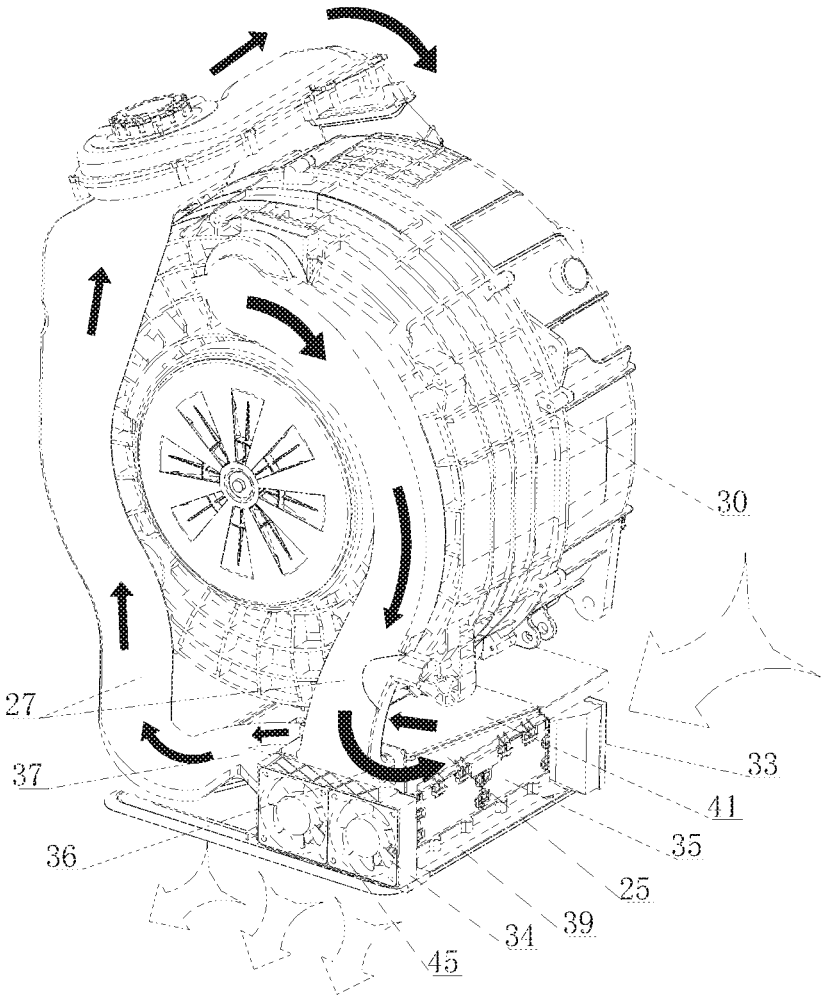
FIG. 2 is an internal structural drawing of a clothes dryer or a washer dryer of the present disclosure.

1: Fin; 11: First Fin; 12: Second Fin; 4: Pin; 5: slot; 6: Profiled Groove; 7: Turnup 8: Frame Plate; 9: Through Hole; 13: Notch; 14: Clamping Column; 15: Clamping Bulge; 16: Hole; 17: Clamping Tongue; 18: Clamping Port; 19: buckle; 20: Clamping Groove; 21: groove; 22: Sheet-Shaped Bulge; 23: Sealing Baffle Plate; 24: Hot Air Inlet; 25: Upper Cover Plate; 26: Filtering Structure; 27: Air Duct; 28: Chamber; 29: Front Panel; 30: Drum; 31: Hot Air path; 32: Cold Air path; 33: Gas Inlet; 34: Fan; 35: Heat Exchanger; 36: Air Inlet; 37: Air Outlet; 38: Ribbed Slab; 39: Lower Cover Plate; 40: Spray Layer; 41: Sealing Cover; 42: Spray Hole; 43: Water Inlet; 44: Water Pump; 45: Gas Inlet; And 46: Side Plate.

DETAILED DESCRIPTION

As shown in FIG. 1, FIG. 2, FIG. 3 and FIG. 4, a clothes dryer or a washer dryer of the present disclosure at least includes a clothes drying system, where the clothes drying system includes a heating structure and a condensing structure; the condensing structure is arranged on a lower part of a drum 30 of the clothes dryer or the washer dryer; the condensing structure includes an air inlet 36 and an air outlet 37 for hot air, and further includes a gas inlet 33 and a gas outlet 45 for cold air, and a heat exchanger 35 is arranged inside the condensing structure; the heat exchanger 35 is composed of fins which are superposed in a longitudinal-transversely alternating manner; the heat exchanger 35 includes two groups of air paths which are mutually intersected, one group of the air paths is connected with a hot air path 31, and the other group of the air paths is connected with a cold air path 32; and a frame with an enclosure structure is arranged outside the heat exchanger 35.

A length direction of the condensing structure is arranged vertically to a front panel 29 or a side plate 46 of the clothes dryer or the washer dryer; and, the length direction of the condensing structure may be arranged vertically to the front panel 29 of the clothes dryer or the washer dryer.

The air inlet 36 of the condensing structure is located in the upper part, and the air outlet 37 is located in the lower part; in this way, during a process that hot air passes through the condensing structure, water vapor in the hot air is condensed into condensed water with cold, and can flow downwards to a condensed water collection device along the inner wall of the condensing structure under the action of gravity; the air inlet 36 and the air outlet 37 are communicated with the drum 30 through an air duct 27 of the clothes drying machine respectively; and one of the gas inlet 33 and the gas outlet 45 is provided with fans, and the other one is communicated with the atmosphere.

The gas inlet 33 is arranged in the front part of the washer dryer, and the gas outlet 45 is arranged in the rear part of the washer dryer; the fans 34 are arranged at the gas outlet 45, and can also be arranged at the gas inlet 33; air is sucked from the front part under the effect of the fans 34, subjected to heat exchange with the hot air in the heat exchanger 35 and then exhausted from the rear part; the front part of the clothes dryer or the washer dryer needs to be opened for taking and placing clothes, and there is no obstacle generally; the gas inlet 33 is arranged in the front part of the clothes dryer or the washer dryer, and capable of ensuring the smoothness of gas inlet; and the gas outlet 45 is arranged in the rear part of the clothes dryer or the washer dryer, and air is exhausted from the rear part, without interference on a front user.

In order to increase the heat exchange efficiency of the condensing structure, a stacked heat exchanger is adopted in the present disclosure, and is made from a plastic material and simple to form; the thickness is controllable and can be controlled to be quite thin; the number of the fins can be increased in an effective space, so that the heat dissipation area can be increased, and then the heat exchange efficiency is increased; and positioning is simple and accurate.

Figure 10:
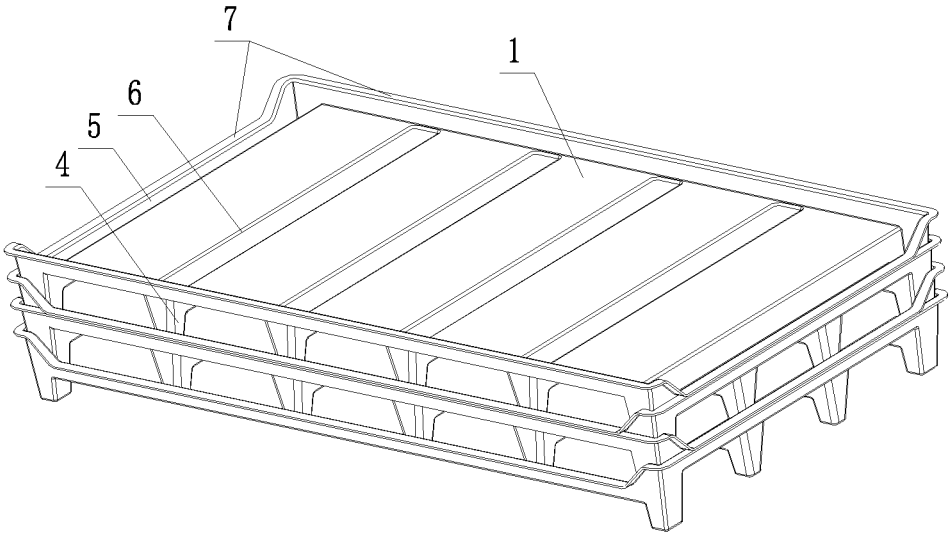
FIG. 10 is a structural diagram of a stacked heat exchanger in the present disclosure.
Figure 11:
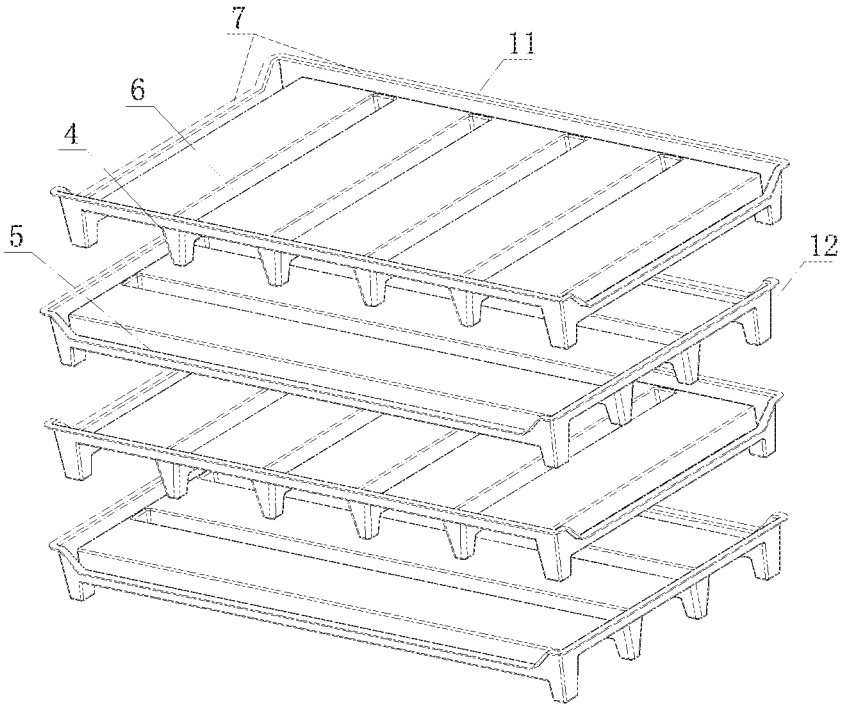
FIG. 11 is an exploded diagram of a stacked heat exchanger in the present disclosure.
Figure 12:
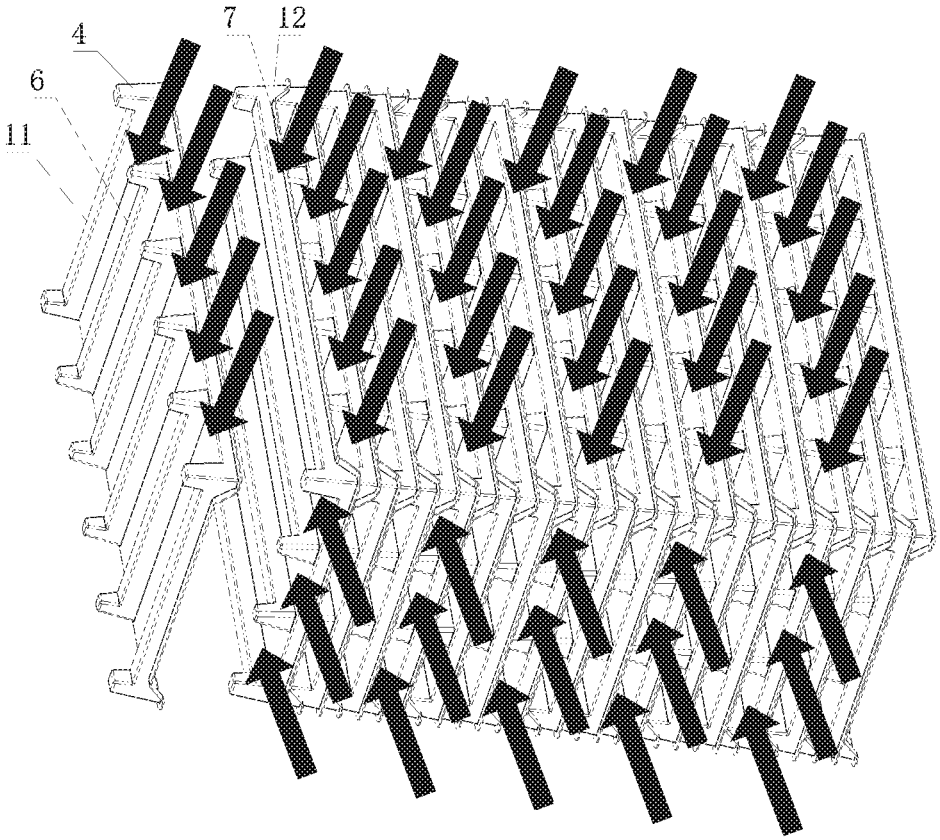
FIG. 12 is a schematic diagram of air paths of a stacked heat exchanger in the present disclosure.

As shown in FIG. 10, FIG. 11 and FIG. 12, the stacked heat exchanger includes a plurality of fins 1 which are superposed up, and two opposite sides of each fin 1 are bent upwards and cooperated with the upper fin 1 of the fin to form a ventilating air path; two adjacent fins 1 are arranged in a longitudinal-transverse alternating manner to form a transversal air path and a longitudinal air path which are mutually independent and spaced in an up-down direction, where a high-temperature air flow can pass through the transversal air path, and a low-temperature air flow can pass through the longitudinal air path; or the low-temperature air flow can pass through the transversal air path, the high-temperature air flow can pass through the longitudinal air path, and the air flows at different temperatures indirectly contact inside to carry out heat exchange. Each fin 1 is made from a plastic material and simple to form; the thickness is controllable and can be controlled to be quite thin; and the number of the fins can be increased in an effective space, so that the heat dissipation area can be increased, and then the heat exchange efficiency is increased.

Where each longitudinal air path is vertically arranged, corresponding to the air inlet 36 and the air outlet 37 of the condensing structure, and connected with the hot air path 31; and each transversal air path is horizontally arranged, corresponding to the gas inlet 33 and the gas outlet 45 of the condensing structure, and connected with the cold air path 32.

Downwards convex pins 4 are arranged on the lower surfaces of the two upwards bent sides of each fin 1, slots 5 matched with the pins 4 are arranged at an air inlet and an air outlet in the front part and the rear part of the air path of each fin 1; the fins 1 are arranged in a longitudinal-transverse alternating manner; the pins 4 of the upper-layer fin correspond to the positions of the slots 5 of the lower-layer fin; and the pins 4 of the upper-layer fin are inserted into the slots 5 of the lower-layer fin of the fin to connect the upper and lower adjacent fins.

Each fin 1 is provided with a plurality of downward profiled grooves 6 in parallel in a manner of being vertical to the direction of the air path formed by the fin and the upper fin of the fin, and the profiled grooves 6 are used for dividing the air path formed by the fin and the lower fin of the fin into a plurality of parallel air paths. The profiled grooves 6 are capable of forming the air paths to guide the air flows, enhancing the strength of the fins to prevent deformation, and playing a role of reinforcing ribs; and the addition of the plurality of profiled grooves 6 is equivalent to the increase of the contact heat dissipation area on the same projection area, and then the heat exchange efficiency is increased.

Each fin 1 is provided with downward profiled grooves 6 at an air inlet and an air outlet in the front part and the rear part of the air path formed by the fin and the upper fin of the fin, and the profiled grooves 6 form the slots 5, that is, the profiled grooves 6 at the air inlet, of each fin 1, are the slots 5; a profiled depth of each of the two ends of each profiled groove 6 is greater than a profiled depth of the middle of the profiled groove to form a downward bulge, thereby forming one of the pins 4; in this way, one of the pins 4 can be formed only by changing the profiled depth, without independent profiling for the pin 4, so that the forming process is simplified; therefore, the positions of the pins 4 and the positions of the profiled grooves 6 are in one-to-one correspondence; however, the positions of the pins 4 are not limited to be corresponding to the positions of the profiled grooves 6 only, and the pins 4 can be distributed at any positions of the lower surfaces of the two upwards bent sides; and one pin is arranged at each of the two ends and at least one pin is distributed at the middle for the best.

Four sides of each fin 1 are bent outwards to form turn-ups 7, the turn-ups 7 of each upper and lower adjacent fins are superposed, the turn-ups 7 at the slots 5 are superposed onto the turn-ups 7 which are bent upwards and then bent outwards, of the lower fin of the fin, and the turn-ups are closely bonded to form a sealed air path, where the turn-ups of the two upwards bent sides are higher than the corresponding fin, the turn-ups of the two sides provided with the slots are lower than the corresponding fin, and the lower turn-ups at the slots of the upper-layer fin are superposed onto the higher turn-ups at the upwards bent parts of the lower-layer fin, and the turn-ups are closely bonded to form a sealed air path, and play a role of limiting simultaneously. The fins are positioned and connected by virtue of the pins 4, the slots 5 and the bent turn-ups 7, and are directly placed and stacked in a longitudinal-transverse alternating manner, without the need of other connection parts; and positioning is simple and accurate.

The thickness of each fin 1 is 0.2 mm to 0.5 mm, the thickness of each fin body is greatly reduced relative to an aluminum alloy heat exchanger, and more heat exchange fins can be arranged in a limited space, thus the heat exchange area is increased, and then the heat exchange efficiency is increased.

The heat exchanger 35 is formed by the plurality of groups of fins in a stacked manner, and the fins include first fins 11 and second fins 12; the two long sides of each first fin 11 are bent upwards and cooperated with the upper fin of the first fin to form a ventilated air path; the two short sides of each second fin 12 are bent upwards and cooperated with the upper fin of the second fin to form a ventilated air path; the first fins 11 and the second fins 12 are of the same structure while being square, and the first fins 11 and the second fins 12 are alternately arranged to form a transversal air path and a longitudinal air path which are mutually independent and spaced in an up-down direction. Turn-ups which extend outwards are arranged around each fin, where the turn-ups of the two upwards-bent sides are higher than the corresponding fin, the turn-ups of the two sides provided with the slots are lower than the corresponding fin, and the lower turn-ups at the slots of the upper-layer fin are superposed onto the higher turn-ups at the upwards bent parts of the lower-layer fin, and the turn-ups are closely bonded to form a sealed air path.

During use of the machine, one air path is in a horizontal direction, and the other air path is in a vertical direction; a low-temperature air flow passes through the air path in the horizontal direction, and a high-temperature air flow passes through the air path in the vertical direction; the air flows are subjected to heat exchange while passing, where water vapor in the high-temperature air flow in the air path in the vertical direction is condensed with cold, and the condensed water flows downwards and out of the heat exchanger along the sidewall of the air path, and is applied to the clothes dryer or the washer dryer; the hot air path 31 is a circulation air path of the clothes dryer or the washer dryer, and the cold air path 32 is an air path. The longitudinal air path is communicated with a wet-hot air outlet of the circulation air path of the clothes dryer or the washer dryer through the fans, and the transversal air path is communicated with external air through the fans; the fans are used for sucking the external air into the air path in the horizontal direction, and sucking the wet-hot air in the clothes dryer into the air path in the vertical direction; the water vapor in the wet-hot air is condensed into condensed water through conduction heat dissipation of the fins, and the condensed water flows downwards and out of the heat exchanger along the sidewall of the air path to achieve a water collection box of the clothes dryer or the washer dryer.

In order to enhance the strength of the heat exchanger, improve the running reliability of the heat exchanger, prolong the service life, reduce the failure maintenance rate of the machine, and reduce the maintenance cost of the machine, a frame is arranged outside the heat exchanger in the present disclosure; a frame plate 8 is arranged on each of the upper side, the lower side, the left side, the right side, the front side and the rear side of the heat exchanger, and the frame is of an enclosure structure formed by connecting the frame plates 8 which are arranged on the side surfaces of the heat exchanger, thus the heat exchanger with the frame is formed.

As shown in FIG. 5, FIG. 6, FIG. 7, FIG. 8 and FIG. 9, through holes 9 cooperated with the air paths of the heat exchanger inside are arranged in the two groups of opposite frame plates 8 on the frame, and the other group of the opposite frame plates 8 is flat plates; on one hand, the flat plates enable the frame to form a sealed cavity, and on the other hand, the flat plates are connected with the other two groups of opposite frame plates to further enhance a connection effect, thereby avoiding deformation of the two groups of opposite frame plates.

A connection part is arranged at the junction of two frame plates of the frame, and two adjacent frame plates are connected through the corresponding connection part; each connection part may be of a buckle structure; and the frame is simple in structure and convenient to install.

Further, each buckle structure is as follows: notches 13 are arranged in the edge of one frame plate 8, a cylindrical clamping column 14 is arranged in each notch 13, a clamping bulge 15 is arranged on the edge of the frame plate 8 connected with the frame plate, a hole 16 is formed in each clamping bulge 15, each clamping bulge 15 is connected into the corresponding notch 13 in an insertion manner, the two frame plates 8 realize positioning, and the clamping column 14 in each notch 13 is connected into the hole 16 in the corresponding clamping bulge 15 in an insertion manner to realize connection.

Or each buckle structure is as follows: T-shaped clamping tongues 17 are arranged on the edge of one frame plate 8, splayed clamping ports 18 are arranged in the edge of the frame plate connected with the frame plate, each T-shaped clamping tongue 17 is connected into the corresponding splayed clamping port 18 in an insertion manner, each T-shaped clamping tongue 17 is inserted from one wider end of the corresponding splayed clamping port 18, each clamping port 18 has a certain deformation amount, one narrower end of each splayed clamping port 18 is strongly jacked to be wide by the corresponding clamping tongue 17, and after the wider head part of each clamping tongue 17 is inserted into the corresponding clamping port 18, the clamping port 18 recovers to an original shape, and the clamping tongue 17 cannot be reversely withdrawn to realize fixed connection.

Or each buckle structure is as follows: convex buckle 19 are arranged on the side surface of the edge of one frame plate 8, a folded edge vertical to the frame plate 8 connected with the frame plate is arranged on the edge of the frame plate, concave clamping grooves 20 are arranged at positions corresponding to the buckles on the side surface of the folded edge, and each buckle is connected with the corresponding clamping groove in a clamping manner.

The abovementioned buckle structures can be used independently, or any two or three of the buckle structures can be used on the same frame in a combined manner.

A plurality of parallel grooves 21 are arranged in the inner surfaces of the two groups of frame plates 8 with the through holes 9, the grooves 21 are corresponding to the closely fitted turn-ups 7 around the heat exchanger, and the closely fitted turn-ups 7 are connected into the grooves 21 in the inner surfaces of the corresponding frame plates in an insertion manner; the turn-ups of each fin 1 and the turn-ups of the upper fin or the lower fin of the fin are closely bonded, and then are inserted into the grooves 21 in the frame; and in this way, the fins can be fixed, and a role of enhancing the strength of the fins to improve the working reliability is also played.

Specifically, the heat exchanger includes a plurality of fins 1 which are superposed up, two opposite sides of each fin are bent upwards and cooperated with the upper fin of the fin to form a ventilating air path; two adjacent fins are arranged in a longitudinal-transverse alternating manner to form a transversal air path and a longitudinal air path which are mutually independent and spaced in an up-down direction; and the through holes arranged in the two groups of opposite frame plates correspond to the inlets and the outlets of the transversal air path and the longitudinal air path respectively. Four sides of each fin 1 are bent outwards to form turn-ups 7, the turn-ups of each upper and lower adjacent fins 1 are superposed, the turn-ups at the slots are superposed onto the turn-ups 7 which are bent upwards and then bent outwards, of the lower fin of the fin, and the turn-ups are closely bonded; and the grooves 21 in the inner surface of each frame plate correspond to the closely fitted turn-ups 7, and the closely fitted turn-ups 7 are connected into the grooves 21 in the inner surfaces of the corresponding frame plates 8 in an insertion manner.

A plurality of sheet-shaped bulges 22 vertical to the two groups of frame plates 8 with the through holes 9 are arranged on each two adjacent edges of the frame plates, the shape of each sheet-shaped bulge 22 is the same as the shape of a space between the corresponding adjacent turn-ups at the corresponding pin, and each sheet-shaped bulge 22 is connected into the space between the corresponding adjacent turn-ups at the corresponding pin in an insertion manner.

Specifically, downwards-convex pins 4 are arranged on the lower surfaces of the two upwards bent sides of each fin 1, downwards concave slots 5 are arranged in the upper surfaces of the other two sides of each fin 1, and the pins 4 of each fin 1 are inserted into the slots 5 of the lower fin of the fin to connect the upper and lower adjacent fins; at least one pin 4 may be arranged at the four corners of each fin respectively, turn-ups 7 which are bent downwards and then bent outwards are arranged at one side of each pin, turn-ups 7 which are bent upwards and then bent outwards are arranged at the other side of each pin, and the turn-ups 7 are smoothly transited at the pin 4; the shape of each sheet-shaped bulge 22 is the same as the shape of a space between the corresponding adjacent turn-ups at the corresponding pin, and each sheet-shaped bulge 22 is connected into the space between the corresponding adjacent turn-ups at the corresponding pin in an insertion manner.

In the heat exchanger with the frame in the present disclosure, the heat exchangers are connected with each other through the pins 4 and the slots 5, and the bonded turn-ups 7 of each two adjacent fins are inserted into the grooves 21 of the corresponding frame plates to fix the heat exchanger and enhance the strength; moreover, the sheet-shaped bulges on the frame plates are inserted into a space between the turn-ups which are transited at the corresponding pin to realize further fixation; and the structures are mutually limited, mutually located, mutually assembled and mutually supported.

Sealing baffle plates 23 are arranged outside the frame; and, sealing baffle plates 23 may be arranged on the edges of the frame plates 8 which are provided with the through holes cooperated with the air paths of the heat exchanger inside to enhance the sealing property of the frame, so that the whole heat exchanger is high in appearance integrality.

In another embodiment of the present disclosure, a plurality of the heat exchangers 35 can be connected for use, thus the contact area and time of the cold air flow and the hot air flow are increased, and then the heat exchange efficiency is increased.

The frame in the present disclosure has both roles of positioned connection and reinforcing, thereby improving the reliable running of components; the frame is further capable of fixing each fin of the heat exchanger, and can be mutually assembled and mutually positioned with each fin; and the frame is simple in structure and convenient to install.

In the clothes dryer or the washer dryer, the condensing structure is used for condensing the wet-hot air on the circulation air path of the clothes dryer or the washer dryer; the lint is generated during running drying, and is liable to accumulate in long-time running due to a high number of fin layers in the heat exchanger 35; in order to prevent the lint brought out by the hot air path 31 from the interior of the clothes dryer or the washer dryer from blocking the air paths of the heat exchanger 35, a filtering structure 26 is arranged at the hot air inlets 24 of the heat exchanger 35, and used for effectively filtering the lint and other impurities and preventing the lint and other impurities from entering the heat exchanger to cause unsmooth flowing in the air paths or cause blockage to the air paths. A filtering structure is arranged at the hot air inlets 24 of the heat exchanger 35, and the filtering structure 26 is arranged between the air inlet 36 of the condensing structure and the hot air inlets 24 of the heat exchanger 36 in a pushable-pullable manner.

Figure 3:
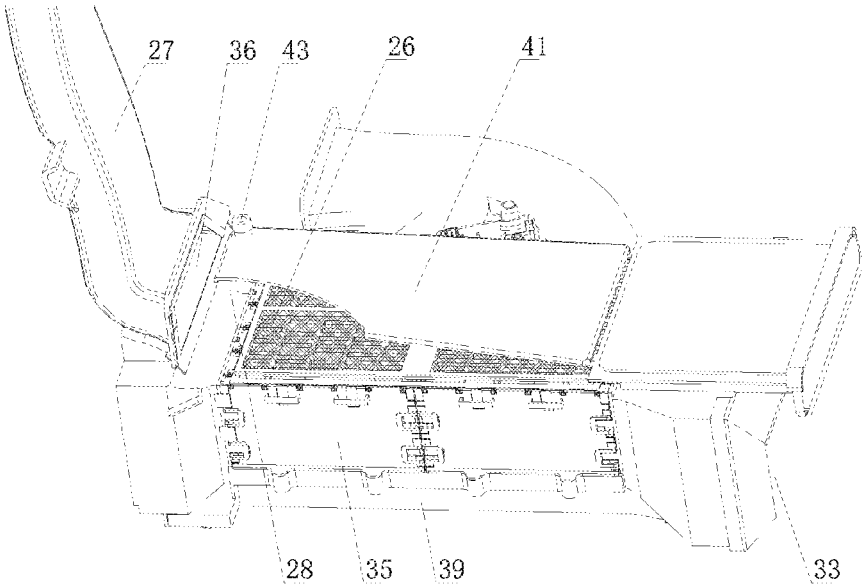
FIG. 3 is a structural diagram of an air condensing structure in the present disclosure.
Figure 4:
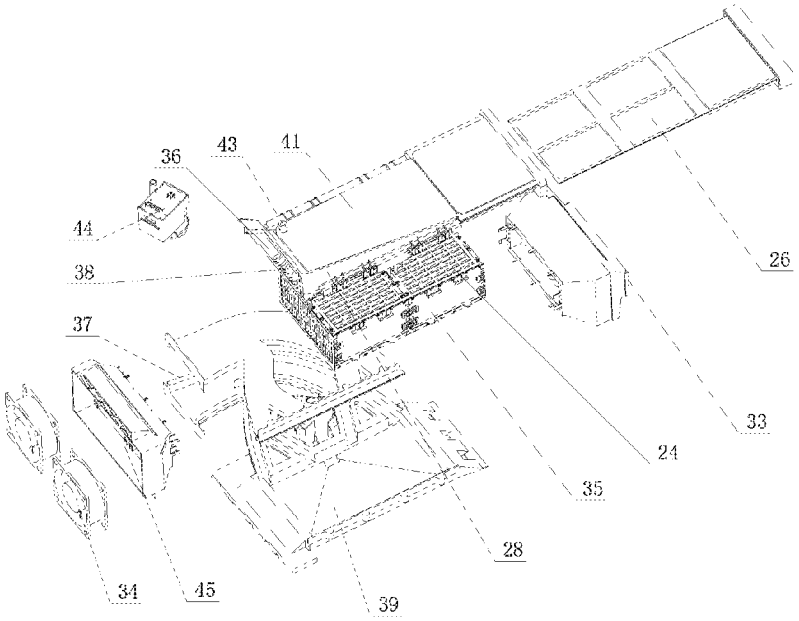
FIG. 4 is an exploded diagram of an air condensing structure in the present disclosure.
Figure 5:
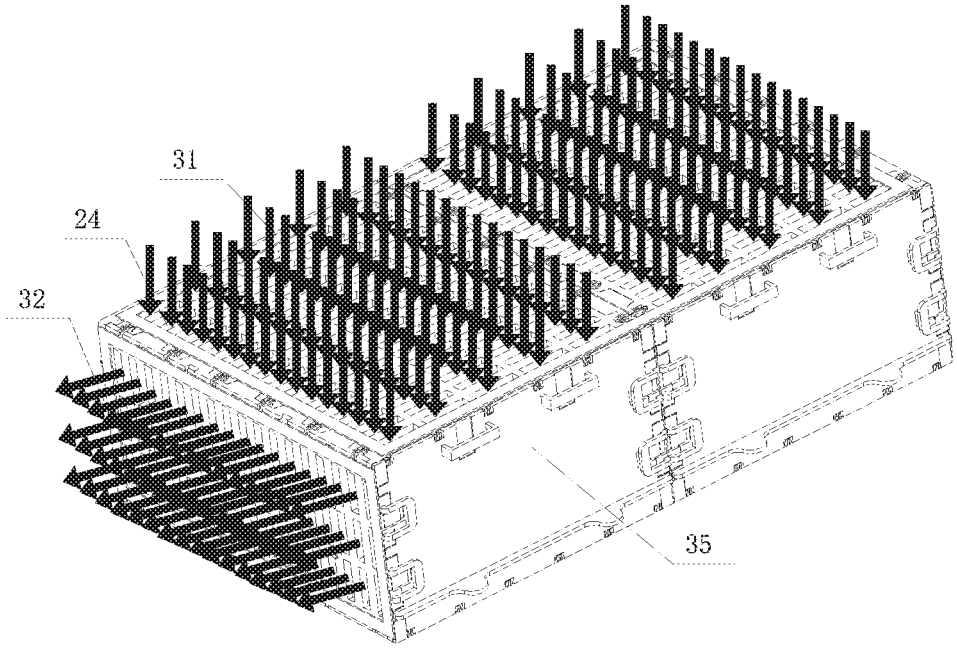
FIG. 5 is a schematic diagram of air paths of a heat exchanger in the present disclosure.
Figure 6:
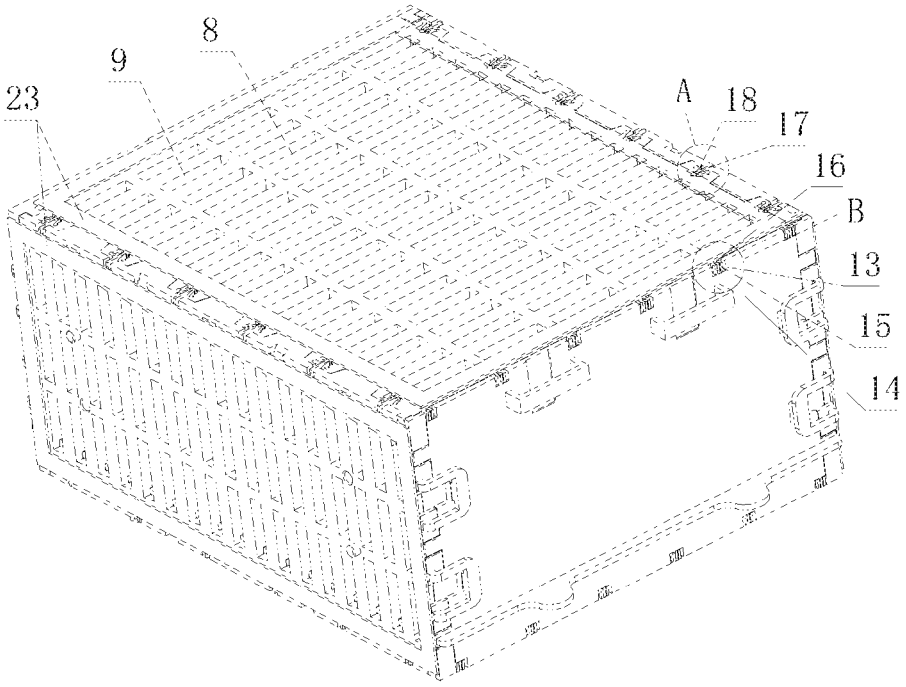
FIG. 6 is a structural diagram of a heat exchanger with a frame in the present disclosure.
Figure 7:
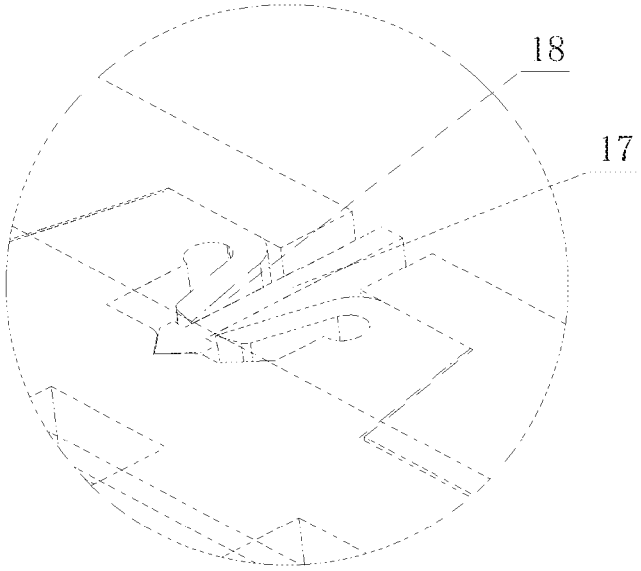
FIG. 7 is an enlarged diagram of a part A in FIG. 6.
Figure 8:
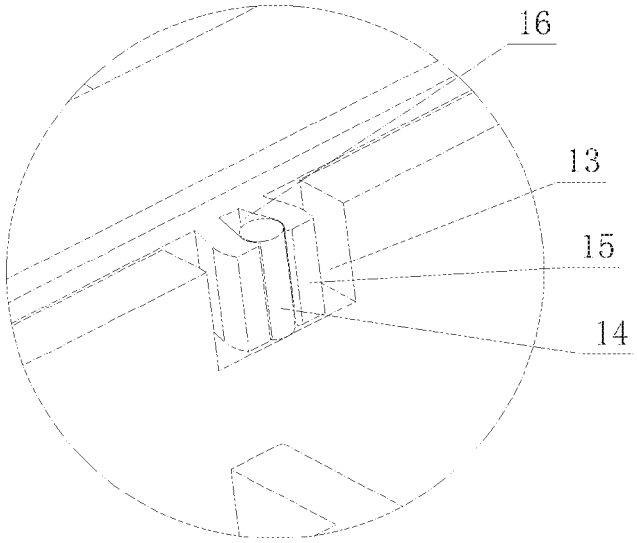
FIG. 8 is an enlarged diagram of a part B in FIG. 6.
Figure 9:
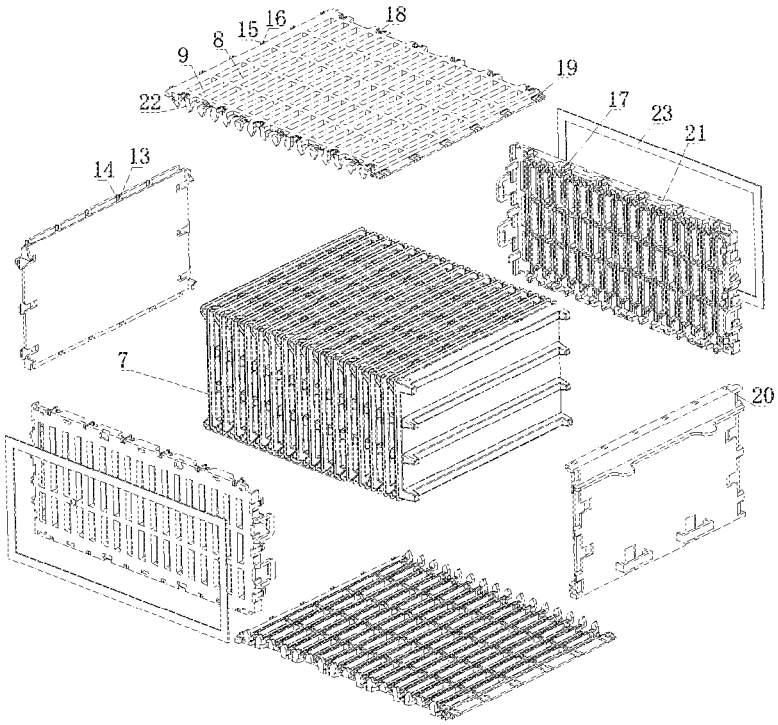
FIG. 9 is an exploded diagram of a heat exchanger in the present disclosure.

As shown in FIG. 3 and FIG. 4, an upper cover plate 25 is arranged at the hot air inlets 24 of the heat exchanger 35, the upper cover plate 25 is provided with an inclined top surface, the upper cover plate 25 and the heat exchanger form a chamber 28, and the air inlet 36 is formed in the chamber 28 at one end where the upper cover plate is inclined highly and far away from the heat exchanger; the end where the upper cover plate is inclined highly and far away from the heat exchanger is bent upwards, and forms the air inlet 36 of the condensing structure with the opposite other side surface; the filtering structure is arranged in the chamber 28, the air inlet 36 is located in one side of the filtering structure, and the hot air inlets 24 of the heat exchanger are located in the other side of the filtering structure. In this way, after the hot air enters the air inlet 36 and before the hot air enters the hot air inlets 24, the lint in the hot air is blocked by the filtering structure, and prevented from entering the heat exchanger, and the filtering structure needs to be regularly cleaned only.

The filtering structure 26 is slidably connected with the sidewall of the chamber 28, and one end of the filtering structure stretches out of the chamber 28; a length of the filtering structure 26 in a pushable-pullable direction is greater than a length of the heat exchanger 35 in the pushable-pullable direction of the filtering structure; when one end of the filtering structure 26 is located on the innermost part of the chamber 28, the other end of the filtering structure is located outside the chamber. The filtering structure 26 can be pulled outwards to be cleaned; and when one end of the filtering structure 26 is located on the innermost part of the chamber 28, the end located outside the chamber 28, of the filtering structure 26, is sealingly connected with an opening which penetrates through the chamber 28, of the filtering structure, thus no leakage of the hot air inside during normal use of the machine is ensured.

Sliding chutes/sliding blocks are arranged on each of the two sides of the filtering structure 26, sliding blocks/sliding chutes are arranged on the sidewall of the chamber corresponding to the filtering structure, each sliding chute/sliding block is cooperated with the corresponding sliding block/sliding chute to form sliding connection, thus pushable-pullable for the filtering structure is facilitated.

The filtering structure 26 and the heat exchanger 35 are arranged at the bottom of the clothes dryer or the washer dryer, and arranged vertically to the front panel 29 of the clothes dryer or the washer dryer; and the filtering structure 26 can be pushed and pulled along a direction vertical to the front panel 29 of the clothes dryer or the washer dryer. One end of the filtering structure 26 is located on the innermost part of the chamber 28, and the other end of the filtering structure 26 is located outside the chamber 28 during normal condensing; and the filtering structure can be cleaned only by opening a bottom trim and pulling outwards the filtering structure during cleaning.

The filtering structure is a filtering screen, and the area of the filtering screen corresponds to the area of the air inlet of the heat exchanger; a frame body is arranged around the filtering screen; slots are arranged in the inner sidewall of the upper cover plate; and the frame body is connected into the slots in the inner sidewall of the upper cover plate in an insertion manner to form sliding connection.

Because the lint is generated during drying, the lint is liable to accumulate in long-time running due to a high number of fin layers of the heat exchanger 35 and a small gap between two adjacent layers; the lint is liable to accumulate at the filtering structure in long-time running after the filtering structure is arranged; in order to facilitate cleaning the lint in the heat exchanger, a flushing structure is arranged at the hot air inlets of the heat exchanger 35; or in order to facilitate cleaning the lint filtered by the filtering structure, a flushing structure is arranged between the air inlet 36 of the condensing structure and the hot air inlets 24 of the heat exchanger; and the flushing structure is located above the filtering structure.

Figure 13:
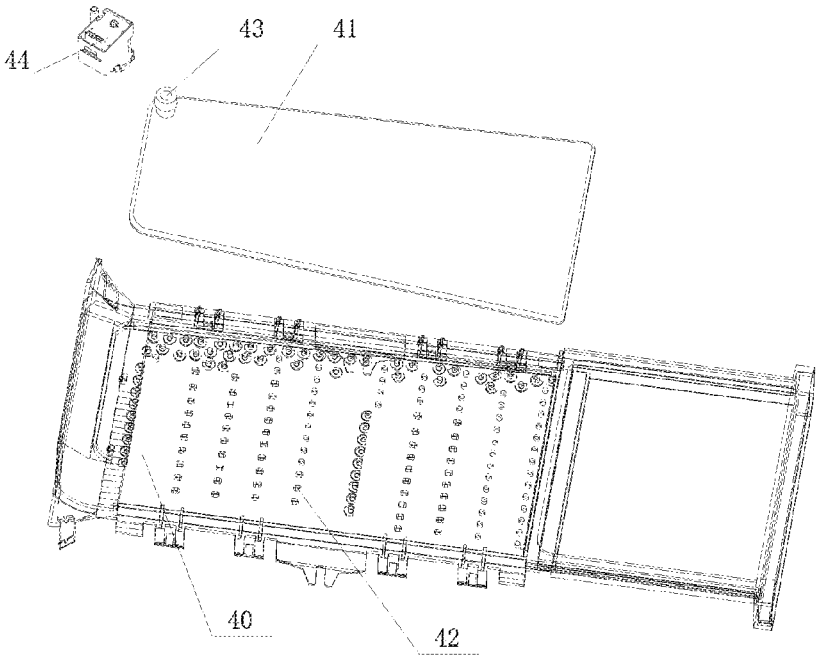
FIG. 13 is a structural diagram of a flushing structure in the present disclosure.

As shown in FIG. 13, the flushing structure includes a spray layer 40 and a sealing cover 41, the spray layer 40 and the sealing cover 41 form a cavity, a plurality of spray holes 42 are arranged in the spray layer 40, a water inlet 43 is arranged in the sealing cover 41, and the water inlet 43 of the sealing cover 41 is connected with a water pump 44, and is communicated with running water or other water sources through the water pump 44. The flushing structure may be used for regularly washing the heat exchanger when drying running is concluded or during a running process; a gap between the spray layer 40 and the sealing cover 41 is small, and a certain water pressure can be formed; and the water pressure enables each spray hole to spray a water column for washing each air path of the heat exchanger.

An upper cover plate 25 is arranged at the hot air inlets 24 of the heat exchanger, the upper cover plate 25 is provided with an inclined top surface, the upper cover plate 25 and the heat exchanger form a chamber 28, and the air inlet is formed in the chamber 28 at one end where the upper cover plate is inclined highly and far away from the heat exchanger; the end where the upper cover plate is inclined highly and far away from the heat exchanger is bent upwards, and forms the air inlet 36 of the condensing structure with the opposite other side surface; the spray layer 40 is the inclined top surface of the upper cover plate 25, and a plurality of spray holes 42 are arranged in the inclined top surface; and the plurality of spray holes 42 are uniformly arranged in the upper cover plate 25.

The hole diameter range of each spray hole 42 is 2 mm to 6 mm, and a distance is 5 mm to 10 mm, thus washing for all the air paths of the heat exchanger is facilitated.

The sealing cover 41 is arranged on the upper part of the upper cover plate 25 and hermetically connected with the upper cover plate 25, and a small gap is formed between the spray layer and the sealing cover. The gap is 4 mm to 8 mm. The gap is capable of ensuring that the entering water can form a certain water pressure inside, and the water pressure enables each spray hole to spray a water column for washing the air paths.

The flushing structure is located on the upper part of the filtering structure 26, and is capable of washing the filtering structure, without the need of opening the bottom trim every time; and the filtering structure 26 can be cleaned only by being withdrawn.

The air inlet 36 of the condensing structure is an integrated air port, the hot air inlets 24 of the heat exchanger are a plurality of air ports, and the section area of the air inlet of the condensing structure is less than the section area of each hot air inlet of the heat exchanger; the air outlet 37 of the condensing structure is an integrated air port, the hot air outlets of the heat exchanger are a plurality of air ports, and the section area of the air outlet 37 of the condensing structure is less than the section area of each hot air outlet of the heat exchanger; in order to realize uniform transition from the air inlet 36 of the condensing structure for hot air to the hot air inlets 24 of the heat exchanger, an air intake uniform structure is arranged between the air inlet 36 of the condensing structure and the hot air inlets 24 of the heat exchanger; in order to realize uniform transition of the hot air from the hot air outlets of the heat exchanger to the air outlet of the condensing structure, an air outtake uniform structure is arranged between the air outlet of the condensing structure to the hot air outlets of the heat exchanger.

Figure 14:
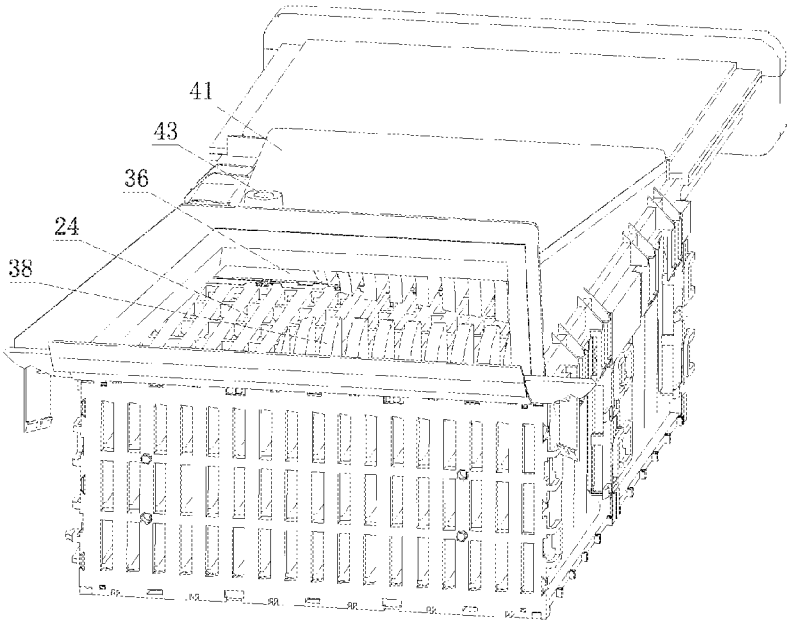
FIG. 14 is a structural diagram of air uniform structures in the present disclosure.
Figure 15:
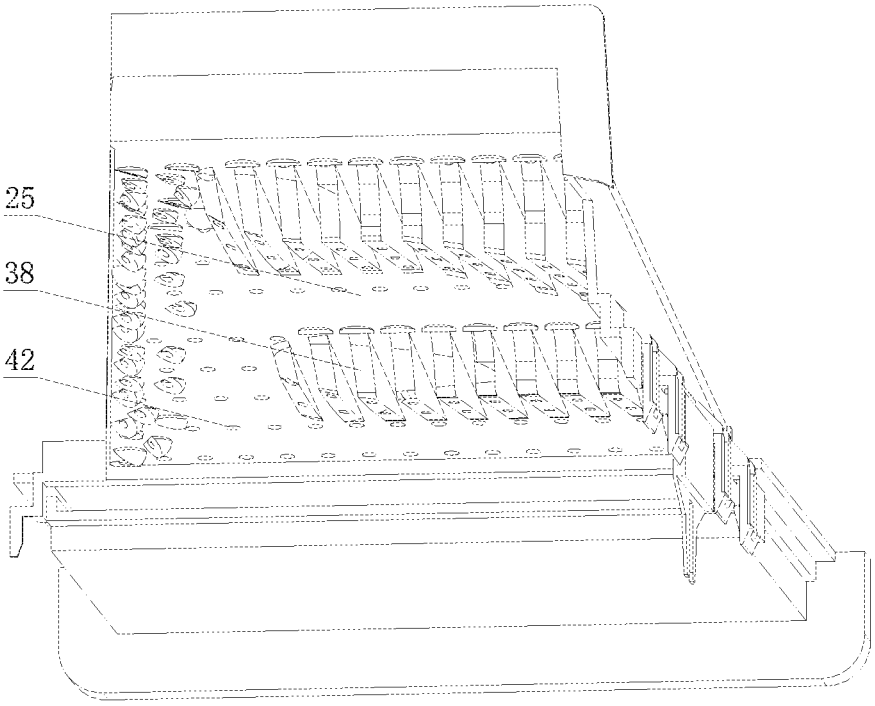
FIG. 15 is a structural diagram of an upper cover plate in the present disclosure.

As shown in FIG. 14 and FIG. 15, the air outtake uniform structure is as follows: an upper cover plate 25 is arranged at the hot air inlets 24 of the heat exchanger, the upper cover plate 25 is provided with an inclined top surface, the upper cover plate 25 and the heat exchanger form a chamber 28, and the air inlet is formed in the chamber at one end where the upper cover plate is inclined highly and far away from the heat exchanger; a plurality of ribbed slabs 38 which are arranged in parallel are arranged on the inner surface of the air inlet, and the ribbed slabs 38 are used for dividing the air inlet 36 into a plurality of air paths. In this way, the hot air uniformly enters each hot air inlet 24 of the heat exchanger under the guide of the air paths composed of the ribbed slabs 38.

The ribbed slabs 38 are arranged along the hot air inlets 24 of the heat exchanger, and a gap space between two adjacent vs 38 corresponds to the corresponding hot air inlet 24 of the heat exchanger 35. The end where the upper cover plate is inclined highly and far away from the heat exchanger is bent upwards, and forms the air inlet por with the opposite other side surface. A plurality of parallel ribbed slabs 38 vertical to the two opposite inner surfaces of the air inlet are uniformly arranged on the inner surfaces, and the ribbed slabs 38 are vertically arranged.

A plurality of parallel ribbed slabs 38 are arranged on the inner surface of the inclined top surface of the upper cover plate 25; the upper parts of the ribbed slabs 38 are connected with the inclined top surface, and the lower parts of the ribbed slabs 38 are suspended; the height changes of the vs 38 corresponds to the inclination angle of the inclined top surface; the heights of the ribbed slabs 38 are gradually reduced from the air inlet to the interior; and a plane composed of the lower parts of the ribbed slabs 38 is parallel to the upper surface of the heat exchanger.

The upper cover plate 25 and the ribbed slabs 38 are integrally arranged, and may be formed through integral injection.

As shown in FIG. 4, the air outtake uniform structure is as follows: a lower cover plate 39 is arranged at the condensed hot air outlets of the heat exchanger, a plurality of air outlets are arranged in one side of the lower cover plate 39, and the plurality of air outlets are communicated with a main air outlet in a shape of Chinese character "众", and are connected to the air ducts 27 of the clothes dryer or the washer dryer; in this way, the condensed hot air outputted from the heat exchanger passes through the plurality of air outlets at first, and then is gathered into the air ducts of the clothes dryer or the washer dryer. The upper cover plate 25 and the lower cover plate 39 are connected with the heat exchanger in a clamping manner, and may be hermetically connected with two flat plate-shaped frame plates.

The above only describes embodiments of the present disclosure. It should be noted that, for those ordinary skilled in the art, several transformations and improvements can be made under the premise of not departing from the principle of the present disclosure, which shall also be considered as the protection scope of the present disclosure.

What is claimed is:

1. A dryer or a washer dryer, comprising a clothes drying system, wherein the clothes drying system comprises a heating structure and a condensing structure; the condensing structure is arranged on a lower part of the dryer or the washer dryer; the condensing structure comprises an air inlet and an air outlet for hot air, and further comprises a gas inlet and a gas outlet for cold air, and a heat exchanger is arranged inside the condensing structure; the heat exchanger is composed of a plurality of fins which are superposed in a longitudinal-transverse alternating manner, and a frame with an enclosure structure is arranged outside the heat exchanger;

wherein two opposite side edges of each fin of the plurality of fins are bent upwards and in coordination with a respective upper fin to form an air path for ventilating, and adjacent fins are arranged in a mode of vertical-horizontal alternating so as to form transversal air paths and longitudinal air paths independent from each other; the longitudinal air paths are vertically arranged to correspond to the air inlet and the air outlet; the transversal air paths are horizontally arranged to correspond to the gas inlet and the gas outlet; downwards convex pins are arranged on lower surfaces of two upwards bent side edges of the each fin, and downwards concave slots are arranged in upper surfaces of other two side edges of the each fin, and the pins of the each fin are inserted into slots of a respective lower fin so as to connect an upper and a lower adjacent fins.

2. The dryer or the washer dryer according to claim 1, wherein a length direction of the condensing structure is arranged vertically to a front panel or a side plate of the washer dryer; the air inlet of the condensing structure is located in an upper part, the air outlet of the condensing structure is located in a lower part, and the air inlet and the air outlet are communicated with a drum through an air duct respectively; and one of the gas inlet and the gas outlet is provided with fans, and the other one is communicated with atmosphere.

3. The dryer or the washer dryer according to claim 1, wherein the each fin is provided with a plurality of downward profiled grooves in parallel in a direction vertical to the air path formed by the each fin and the respective upper fin, and an air path formed with a respective lower fin is divided into a plurality of parallel air paths by the plurality of downward profiled grooves; downward profiled grooves provided on the each fin in the air inlet and the air outlet in a front and a rear of the air path formed between the each fin and the respective upper fin form the slots of the each fin;

and, a profiled depth on both ends of the profiled grooves is greater than a profiled depth in middle of the profiled grooves, so that a downward bulge is formed, so as to form the pins.

4. The dryer or the washer dryer according to claim 1, wherein four side edges of the each fin are bent outwards to form turn-ups; turn-ups of adjoining upper and lower fins are overlapped; turn-ups at the slots are overlapped and fitted closely on turn-ups, which are bent upwards first before bent outwards, on a lower fin; and, the fins are plastic fins.

5. The dryer or the washer dryer according to claim 1, wherein frame plates are arranged on an upper side, a lower side, a left side, a right side, a front side and a rear side of the heat exchanger, and the frame is of an enclosure structure formed by connecting the frame plates; wherein through holes cooperated with air paths of an internal heat exchanger are arranged in two groups of opposite frame plates opposite to the transversal air paths and the longitudinal air paths, and another group of opposite frame plates are flat plates; and, the through holes are rectangular through holes arranged transversally and longitudinally.

6. The dryer or the washer dryer according to claim 5, wherein a connection part is arranged at a junction of each frame plate on the frame, and adjacent frame plates are connected through respective connection parts; the connection part of the each frame plate is of a buckle structure; a plurality of parallel grooves are arranged on internal surfaces of the two groups of opposite frame plates with the through holes, and the parallel grooves correspond to closely fitted turn-ups around the heat exchanger, and the closely fitted turn-ups are inserted into the parallel grooves of the internal surfaces of the two groups of opposite frame plates; and, a plurality of sheet-shaped bulges vertical to each of the two groups of opposite frame plates are arranged on adjacent edges of the each of the two groups of opposite frame plates with the through holes; a shape of each of the sheet-shaped bulges is identical with that of a space between corresponding adjacent turn-ups at a respective pin, and the each of the sheet-shaped bulges is inserted into the space between the corresponding adjacent turn-ups at the respective pin.

7. The dryer or the washer dryer according to claim 1, wherein an upper cover plate is arranged at hot air inlets of the heat exchanger, the upper cover plate has a inclined top surface, the upper cover plate forms a chamber with the heat exchanger, and the air inlet of the condensing structure is formed on the chamber at one end where the upper cover plate is inclined highly and away from the heat exchanger; a lower cover plate is arranged at hot air outlets of the heat exchanger, one side of the lower cover plate is the air outlet of the condensing structure; and the upper cover plate and the lower cover plate are connected with flat frame plates.

8. The dryer or the washer dryer according to claim 7, wherein a filtering structure is arranged between the air inlet of the condensing structure and the hot air inlets of the heat exchanger; the filtering structure is arranged between the air inlet of the condensing structure and the hot air inlets of the heat exchanger in a pushable-pullable manner; the filtering structure is arranged in the chamber, the filtering structure is slidably connected with sidewalls of the chamber, one end of the filtering structure protrudes out of the chamber, and when one end of the filtering structure is located in the innermost part of the chamber, the other end of the filtering structure is located outside the chamber and hermetically connected with an opening of the chamber through which the filter penetrates; and, sliding chutes/sliding blocks are arranged on two side edges of the filtering structure, and sliding blocks/sliding chutes are arranged on corresponding sidewalls of the chamber, and the sliding chutes/sliding blocks of the filtering structure are matched with the sliding blocks/sliding chutes of the chamber so as to form sliding connection.

9. The dryer or the washer dryer according to claim 1, wherein a flushing structure is arranged between the air inlet of the condensing structure and hot air inlets of the heat exchanger; the flushing structure comprises a spray layer and a sealing cover which form a cavity; a plurality of spray holes are arranged in the spray layer; water inlets are arranged in the sealing cover; the spray layer serves as an upper cover plate arranged at the hot air inlets of the heat exchanger; the sealing cover is arranged on an upper part of the upper cover plate and hermetically connected with the upper cover plate, and a plurality of spray holes are arranged in the upper cover plate.

10. The dryer or the washer dryer according to claim 7, wherein an air intake uniform structure is arranged between the air inlet of the condensing structure and the hot air inlets of the heat exchanger; a plurality of vertical ribbed slabs are arranged in the air inlet and on an inner surface of top of the upper cover plate so as to divide the air inlet into a plurality of uniform air paths, so that the air intake uniform structure is formed; an air outtake uniform structure is arranged between the air outlet of the condensing structure and the hot air outlets of the heat exchanger; and, a plurality of air outlets are arranged on one side of the lower cover plate, and the plurality of air outlets in a shape of Chinese character "众" are communicated to a general air outlet, so that the air outtake uniform structure is formed.

11. The dryer or the washer dryer according to claim 2, wherein the each fin is provided with a plurality of downward profiled grooves in parallel in a direction vertical to the air path formed by the each fin and the respective upper fin, and an air path formed with a respective lower fin is divided into a plurality of parallel air paths by the plurality of downward profiled grooves; downward profiled grooves provided on the each fin in the air inlet and the air outlet in a front and a rear of the air path formed between the each fin and the respective upper fin form the slots of the each fin; and, a profiled depth on both ends of the profiled grooves is greater than a profiled depth in middle of the profiled grooves, so that a downward bulge is formed, so as to form the pins.

12. The dryer or the washer dryer according to claim 3, wherein four side edges of the each fin are bent outwards to form turn-ups; turn-ups of adjoining upper and lower fins are overlapped; turn-ups at the slots are overlapped and fitted closely on turn-ups, which are bent upwards first before bent outwards, on a lower fin; and, the fins are plastic fins.

13. The dryer or the washer dryer according to claim 2, wherein frame plates are arranged on an upper side, a lower side, a left side, a right side, a front side and a rear side of the heat exchanger, and the frame is of an enclosure structure formed by connecting the frame plates; wherein through holes cooperated with air paths of an internal heat exchanger are arranged in two groups of opposite frame plates opposite to the transversal air paths and the longitudinal air paths, and another group of opposite frame plates are flat plates; and, the through holes are rectangular through holes arranged transversally and longitudinally.

14. The dryer or the washer dryer according to claim 3, wherein frame plates are arranged on an upper side, a lower side, a left side, a right side, a front side and a rear side of the heat exchanger, and the frame is of an enclosure structure formed by connecting the frame plates; wherein through holes cooperated with air paths of an internal heat exchanger are arranged in two groups of opposite frame plates opposite to the transversal air paths and the longitudinal air paths, and another group of opposite frame plates are flat plates; and, the through holes are rectangular through holes arranged transversally and longitudinally.

15. The dryer or the washer dryer according to claim 4, wherein frame plates are arranged on an upper side, a lower side, a left side, a right side, a front side and a rear side of the heat exchanger, and the frame is of an enclosure structure formed by connecting the frame plates; wherein through holes cooperated with air paths of an internal heat exchanger are arranged in two groups of opposite frame plates opposite to the transversal air paths and the longitudinal air paths, and another group of opposite frame plates are flat plates; and, the through holes are rectangular through holes arranged transversally and longitudinally.

16. The dryer or the washer dryer according to claim 2, wherein an upper cover plate is arranged at hot air inlets of the heat exchanger, the upper cover plate has a inclined top surface, the upper cover plate forms a chamber with the heat exchanger, and the air inlet of the condensing structure is formed on the chamber at one end where the upper cover plate is inclined highly and away from the heat exchanger; a lower cover plate is arranged at hot air outlets of the heat exchanger, one side of the lower cover plate is the air outlet of the condensing structure; and the upper cover plate and the lower cover plate are connected with flat frame plates.

* * * * *